US009352392B2

(12) United States Patent
Kikuchi et al.

(10) Patent No.: US 9,352,392 B2
(45) Date of Patent: May 31, 2016

(54) DIE CASTING APPARATUS

(71) Applicant: TOYOTA JIDOSHA KABUSHIKI KAISHA, Toyota-shi (JP)

(72) Inventors: Makoto Kikuchi, Nissin (JP); Takashi Tomita, Toyota (JP); Hiromi Munekata, Okazaki (JP); Yuji Kayashita, Toyota (JP); Koji Kawahara, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/790,770

(22) Filed: Jul. 2, 2015

(65) Prior Publication Data

US 2016/0016228 A1 Jan. 21, 2016

(30) Foreign Application Priority Data

Jul. 16, 2014 (JP) ..... 2014-145540

(51) Int. Cl.

| | |
|---|---|
| ***B22D 17/30*** | (2006.01) |
| ***B22D 17/20*** | (2006.01) |
| ***B22D 17/02*** | (2006.01) |
| ***B22D 39/00*** | (2006.01) |
| ***B22D 17/10*** | (2006.01) |

(52) U.S. Cl.

CPC ..... *B22D 39/003* (2013.01); *B22D 17/10* (2013.01); *B22D 17/2023* (2013.01); *B22D 17/30* (2013.01)

(58) Field of Classification Search

CPC ..... B22D 39/003; B22D 17/02; B22D 17/04; B22D 17/06; B22D 17/2023; B22D 17/30

USPC ..... 164/113, 312–318

See application file for complete search history.

(56) References Cited

U.S. PATENT DOCUMENTS

| | | | | |
|---|---|---|---|---|
| 6,953,079 | B2 * | 10/2005 | Suzuki | B22D 17/2236 164/256 |
| 2004/0191097 | A1 * | 9/2004 | Nakagawa | B22D 17/04 417/454 |
| 2007/0023159 | A1 * | 2/2007 | Taniguchi | B22D 17/30 164/113 |
| 2014/0216678 | A1 | 8/2014 | Kikuchi | |

FOREIGN PATENT DOCUMENTS

| | | | |
|---|---|---|---|
| JP | 2013-66896 | A | 4/2013 |

* cited by examiner

*Primary Examiner* — Kevin E Yoon

(74) *Attorney, Agent, or Firm* — Oblon, McClelland, Maier & Neustadt, L.L.P

(57) ABSTRACT

The invention provides a die casting apparatus which pumps up molten metal from a molten metal holding furnace through an electromagnetic pump pipe provided with an electromagnetic pump, supplies the pumped-up molten metal to an injection sleeve through the molten metal supply pipe connected with the electromagnetic pump pipe, and a cavity of a die is charged with the molten metal by injecting the molten metal by using an injection tip. An upper end side of the electromagnetic pump pipe and an upper end side of the molten metal supply pipe are connected with each other. The upper end side of the electromagnetic pump pipe is inserted into the upper end side of the molten metal supply pipe, and extends inside the molten metal supply pipe.

8 Claims, 3 Drawing Sheets

DIE CASTING APPARATUS

INCORPORATION BY REFERENCE

The disclosure of Japanese Patent Application No. 2014-145540 filed on Jul. 16, 2014 including the specification, drawings and abstract is incorporated herein by reference in its entirety.

BACKGROUND OF THE INVENTION

1. Field of the Invention

The invention relates to a technology of a die casting apparatus.

2. Description of Related Art

A die casting apparatus is a casting apparatus that mass-produces castings with high dimensional accuracy in a short period of time by pressing molten metal into a die (a cavity) (for example, see Japanese Patent Application Publication No. 2013-66896 (JP 2013-66896 A)). For example, in a die casting apparatus described in JP 2013-66896 A, an electromagnetic pump pipe provided with an electromagnetic pump pumps up molten metal from a molten metal holding furnace to an uppermost part. Then, a molten metal supply pipe, which is connected with the electromagnetic pump pipe, supplies the molten metal to an injection sleeve from the uppermost part of the electromagnetic pump pipe.

In the die casting apparatus according to the related art, the electromagnetic pump pipe and the molten metal supply pipe are joined together by a flange joint through a sealing material at the uppermost part of the electromagnetic pump pipe. At this time, a step is formed inside the pipe due to misalignment that happens when assembling the electromagnetic pump pipe and the molten metal supply pipe. Therefore, molten metal remains at the step inside the pipe, the remaining molten metal is solidified, and the solidified molten metal could cause clogging of the pipe.

Therefore, it has been desired to prevent clogging with molten metal and improve maintainability in a die casting apparatus.

SUMMARY OF THE INVENTION

An aspect of the invention provides a die casting apparatus in which clogging the die casting apparatus with molten metal is prevented, thereby improving maintainability.

Structure of the invention is explained.

A die casting apparatus includes an electromagnetic pump pipe provided with an electromagnetic pump, and a molten metal supply pipe connected with the electromagnetic pump pipe. Molten metal is pumped up from a molten metal holding furnace through the electromagnetic pump pipe provided with the electromagnetic pump, the pumped-up molten metal is supplied to an injection sleeve through the molten metal supply pipe connected with the electromagnetic pump pipe, and a cavity of a die is charged with the pumped-up molten metal by injecting the molten metal by using an injection tip, an upper end side of the electromagnetic pump pipe and an upper end side of the molten metal supply pipe are connected with each other, and the upper end side of the electromagnetic pump pipe is inserted into the upper end side of the molten metal supply pipe, and extends inside the molten metal supply pipe.

In the die casting apparatus, inside of piping from the electromagnetic pump pipe to the molten metal supply pipe may be structured so as to be sealable.

In the die casting apparatus, an opening and closing portion may be provided on the upper end side of the molten metal supply pipe.

In the die casting apparatus, a heater may be provided on the upper end sides of the electromagnetic pump pipe and the molten metal supply pipe.

In the die casting apparatus, an extended portion of the electromagnetic pump pipe may extend to a part of the molten metal supply pipe, which is closer to a molten metal supply opening than an insertion portion of the molten metal supply pipe.

In the die casting apparatus, the molten metal supply pipe may extend downward continuously when the molten metal supply pipe extending towards the molten metal supply opening side, from a part of the molten metal supply pipe, in which an extended portion of the electromagnetic pump pipe extends, to a part of the molten metal supply pipe, which is inserted into the molten metal supply opening.

In the die casting apparatus, the electromagnetic pump pipe may extend upwardly to be inclined to a horizontal plane, and the molten metal supply pipe may extend upwardly to be inclined to the horizontal plane.

In the die casting apparatus, the upper end side of the electromagnetic pump pipe and the upper end side of the molten metal supply pipe may be connected with each other orthogonally.

According to the die casting apparatus of the aspect of the invention, it is possible to prevent clogging the die casting apparatus with molten metal and improve maintainability.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
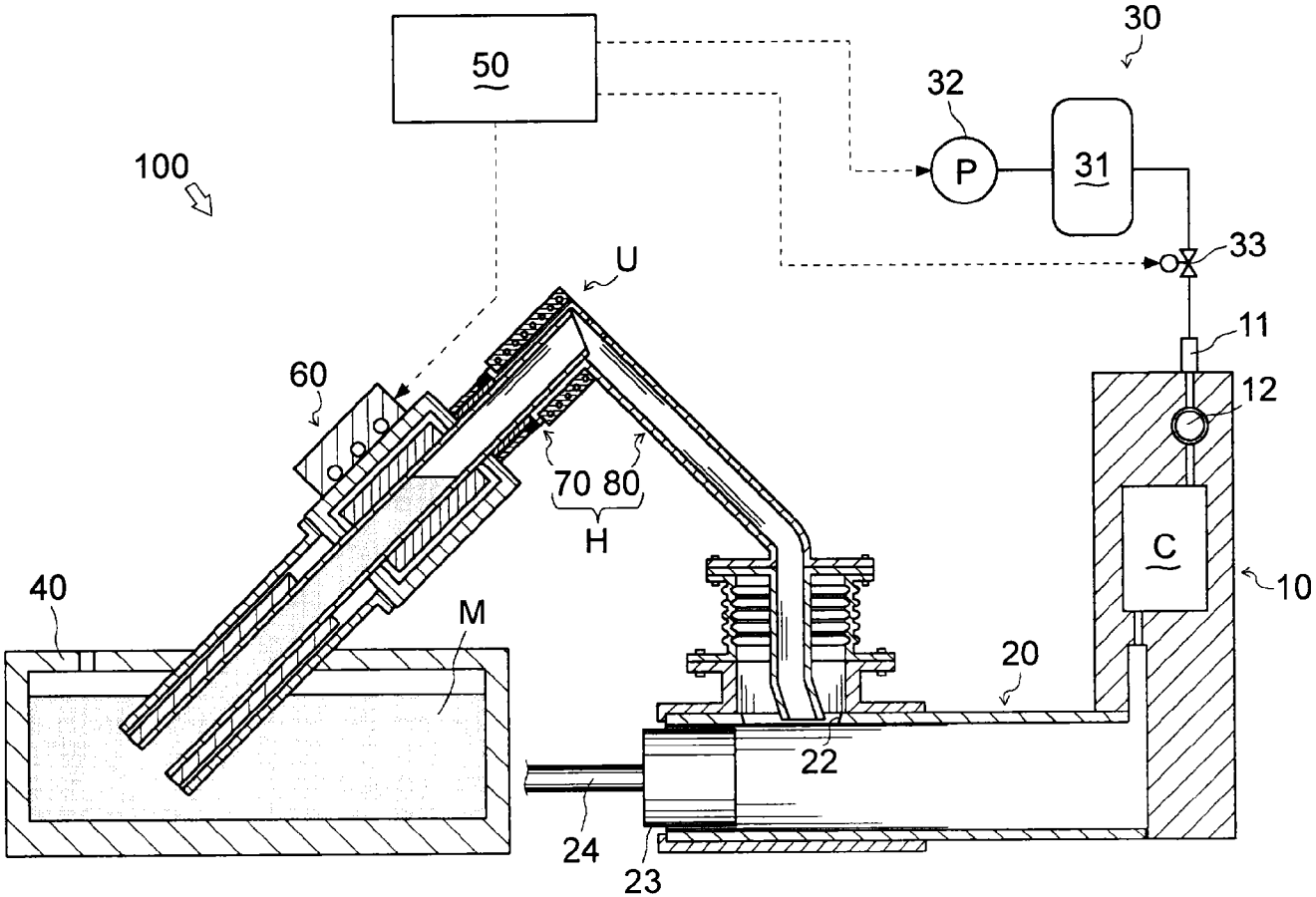
FIG. 1 is a side sectional view showing a structure of a die casting apparatus.

A structure of a die casting apparatus 100 is explained. FIG. 1 schematically shows the die casting apparatus 100 in a side sectional view. Also, in FIG. 1, broken lines express electric signal lines.

The die casting apparatus 100 is an embodiment of a die casting apparatus according to the invention. The die casting apparatus 100 is a casting apparatus which mass-produces castings with high dimensional accuracy in a short period of time by pressing molten metal M into a cavity C.

The die casting apparatus 100 is provided with a die 10, an injection sleeve 20, a decompression device 30, a molten metal holding furnace 40, a controller 50, an electromagnetic pump 60, an electromagnetic pump pipe 70, and a molten metal supply pipe 80.

The cavity C is formed inside the die 10. The die 10 includes a suction opening 11 and a shut valve 12. The suction opening 11 communicates with the cavity C, and sucks in air inside the cavity C. The shut valve 12 is provided in a path that connects the cavity C and the suction opening 11 with each other.

The injection sleeve 20 is structured into a generally cylindrical shape, and receives the injection tip 23 in a sliding fashion. The injection sleeve 20 is attached to the die 10 and communicates with the cavity C. In the injection sleeve 20, a molten metal supply opening 22 is formed. A lower end side of the molten metal supply pipe 80 is inserted into the molten metal supply opening 22.

The injection tip 23 pushes out the molten metal M, which is supplied into the injection sleeve 20 through the molten metal supply opening 22, thereby injecting the molten metal M into the cavity C. The injection tip 23 is provided on a distal end side of a support shaft 24. The support shaft 24 is inserted into the injection sleeve 20, and is controlled to move forward and backward by, for example, a hydraulic cylinder (not shown).

The decompression device 30 is a device that evacuates the cavity C. The decompression device 30 is connected with the suction opening 11, and is communicated with the cavity C. The decompression device 30 is provided with a decompression tank 31, a vacuum pump 32, and an on-off valve 33. The decompression tank 31 and the vacuum pump 32 are connected with the suction opening 11 of the die 10 through the on-off valve 33. The vacuum pump 32 and the on-off valve 33 are connected with the controller 50.

The molten metal holding furnace 40 stores the molten metal M. The molten metal holding furnace 40 stores the molten metal M while blocking the molten metal M from the atmosphere.

The electromagnetic pump 60 pumps up the molten metal M from the molten metal holding furnace 40. The electromagnetic pump 60 is provided in a middle of the electromagnetic pump pipe 70. An inner peripheral part of the electromagnetic pump 60 is formed of ceramics, and the electromagnetic pump 60 pumps up or returns the molten metal M through the electromagnetic pump pipe 70 by using electromagnetic force as voltage is applied to a coil installed in the electromagnetic pump 60. The electromagnetic pump 60 is connected with the controller 50.

The electromagnetic pump pipe 70 and the molten metal supply pipe 80 constitute supply piping H for supplying the molten metal M within the molten metal holding furnace 40 to the injection sleeve 20. The electromagnetic pump pipe 70 extends obliquely upwardly from inside the molten metal holding furnace 40, and is a pipe in which the molten metal M, which is pumped up by the electromagnetic pump 60 from the molten metal holding furnace 40, flows.

An upper end side of the electromagnetic pump pipe 70 is connected with the molten metal supply pipe 80 at an upper end portion U of the supply piping H, and a lower end side of the electromagnetic pump pipe 70 is inserted into the molten metal holding furnace 40. In other words, a connecting portion of the electromagnetic pump pipe 70 and the molten metal supply pipe 80 is located in the upper end portion U of the supply piping H.

In the middle of the electromagnetic pump pipe 70, the electromagnetic pump 60 is provided. The electromagnetic pump pipe 70 extends upwardly and is inclined at about 45° to a horizontal plane. The electromagnetic pump 60 pumps up the molten metal M in the molten metal holding furnace 40 up to the upper end portion U of the supply piping H through the electromagnetic pump pipe 70.

The molten metal supply pipe 80 is a pipe that supplies the molten metal M, which is pumped up to the upper end portion U of the supply piping H through the electromagnetic pump pipe 70, to the molten metal supply opening 22 of the injection sleeve 20. An upper end side of the molten metal supply pipe 80 is connected with the electromagnetic pump pipe 70 at the upper end portion U of the supply piping H, and the lower end side of the molten metal supply pipe 80 is inserted into the molten metal supply opening 22 of the injection sleeve 20. The molten metal supply pipe 80 extends upwardly and is inclined at about 45° to the horizontal plane.

Inside of piping from the electromagnetic pump pipe 70 to the molten metal supply pipe 80 is structured so as to be sealable. Inside of piping from the molten metal holding furnace 40 to the cavity C through the electromagnetic pump pipe 70 and the molten metal supply pipe 80 is also structured so as to be sealable.

The controller 50 is connected with the vacuum pump 32, the on-off valve 33, and the electromagnetic pump 60. The controller 50 has functions of causing the vacuum pump 32 to reduce pressure inside the cavity C and the injection sleeve 20, and causing the electromagnetic pump 60 to supply a proper amount of the molten metal M to the injection sleeve 20.

Figure 2:
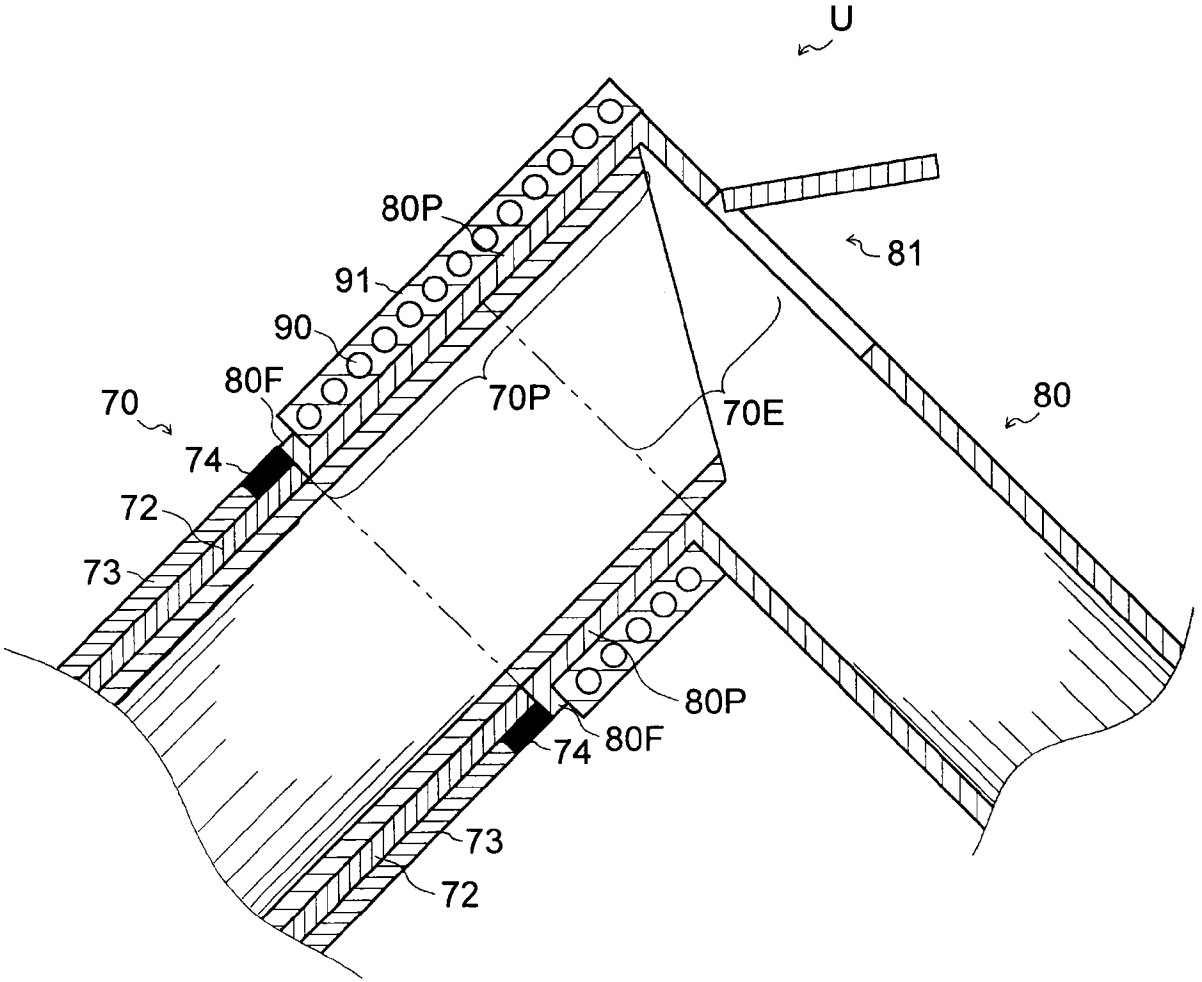
FIG. 2 is a side sectional view showing an upper end portion.

A structure of the upper end portion U of the supply piping H is explained by using FIG. 2. FIG. 2 schematically shows a structure of the upper end portion U in a side sectional view.

The upper end portion U is a portion where the upper end side of the electromagnetic pump pipe 70 and the upper end side of the molten metal supply pipe 80 are connected with each other generally orthogonally. The upper end portion U is also a part where the molten metal M, which is pumped up by the electromagnetic pump 60 from the molten metal holding furnace 40 to the upper end of the electromagnetic pump pipe 70, falls by gravity towards inside the molten metal supply pipe 80.

In the upper end portion U, the upper end side of the electromagnetic pump pipe 70 is inserted into an insertion portion 80P of the molten metal supply pipe 80, which is described later. Here, a portion of the upper end side of the electromagnetic pump pipe 70, which is inserted into the insertion portion 80P of the molten metal supply pipe 80, is referred to as an inserted portion 70P.

The inserted portion 70P of the electromagnetic pump pipe 70 is inserted into the upper end side of the molten metal supply pipe 80, and extends inside the molten metal supply pipe 80. In other words, the upper end of the electromagnetic pump pipe 70 (the inserted portion 70P) extends inside the molten metal supply pipe 80 that extends downwardly. Here, a part of the inserted portion 70P of the electromagnetic pump pipe 70, which extends inside the molten metal supply pipe 80, is referred to as an extended portion 70E.

A protective pipe 72 is wound on an outer periphery of a part of the electromagnetic pump pipe 70, which is located lower than the inserted portion 70P. A pipe cover 73 is wound on an outer periphery of the protective pipe 72 except a part of the upper end side of the protective pipe 72. On the part on the upper end side of the protective pipe 72, where the pipe cover 73 is not wound, a sealing material 74 is wound.

The sealing material 74 seals a gap between the inserted portion 70P of the electromagnetic pump pipe 70 and the insertion portion 80P of the molten metal supply pipe 80, and a gap between a flange portion 80F of the molten metal supply pipe 80 and the protective pipe 72, thereby preventing the molten metal M from leaking.

In the upper end portion U, the upper end side of the molten metal supply pipe 80 is bent at about 90°, thereby forming the insertion portion 80P. The flange portion 80F is formed in the lower end side of the insertion portion 80P. An opening and closing portion 81 is formed in the upper end side of the molten metal supply pipe 80. A heater 90 is wound on the insertion portion 80P of the molten metal supply pipe 80. The heater 90 is covered with a heat insulation material 91.

The extended portion 70E of the electromagnetic pump pipe 70 extends to a part of the molten metal supply pipe 80, which is closer to the molten metal supply opening 22 than the insertion portion 80P. In short, from a part of the molten metal supply pipe 80, in which the extended portion 70E extends, to a part of the molten metal supply pipe 80 inserted into the molten metal supply opening 22, the molten metal supply pipe 80 extends downward continuously when the molten metal supply pipe 80 extending towards the molten metal supply opening 22 side.

Figure 3:
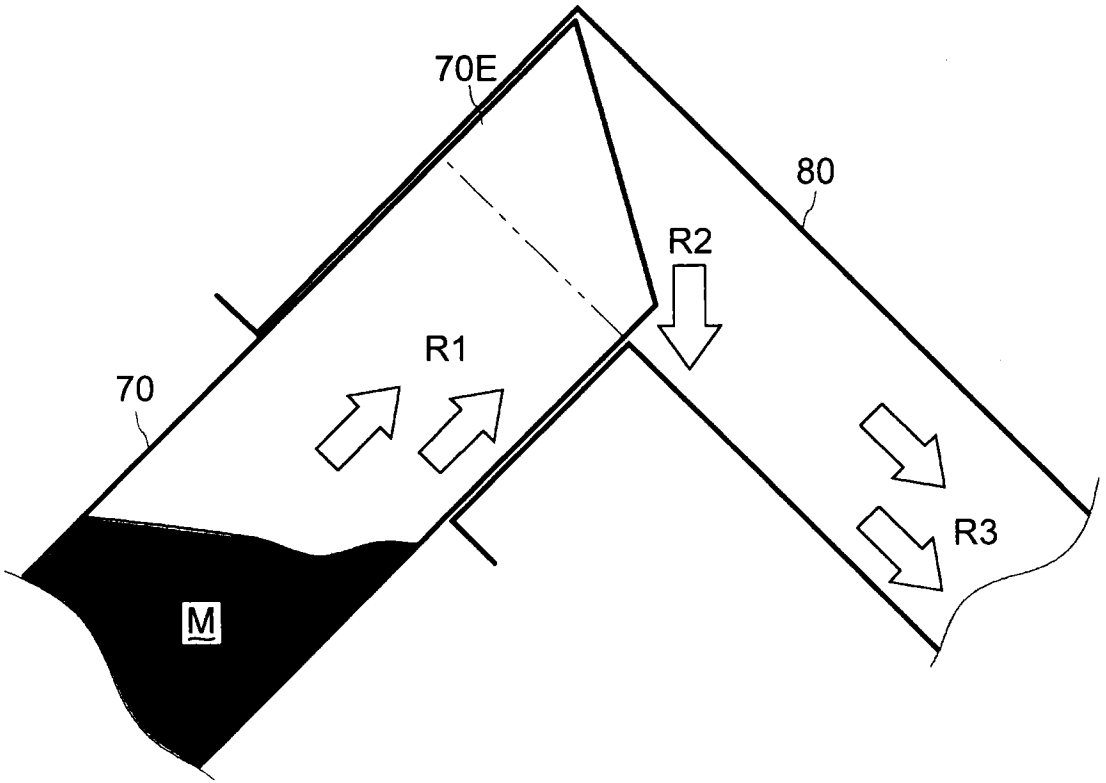
FIG. 3 is a schematic view showing an operation of the upper end portion.

An operation of the upper end portion U is explained by using FIG. 3. FIG. 3 schematically shows an operation of the upper end portion U. In FIG. 3, flows R1, R2, R3 of the molten metal M are expressed by outlined arrows, respectively.

The molten metal M is pumped up to a position located at a given height inside the electromagnetic pump pipe 70. The given height is a height position of the molten metal M inside the electromagnetic pump pipe 70 when the electromagnetic pump 60 (see FIG. 1) stopped in previous injection.

Then, once the electromagnetic pump 60 is activated, the molten metal M, which is pumped up to the given height position, is pumped up further inside the electromagnetic pump pipe 70. The molten metal M that is pumped up further by the electromagnetic pump 60 continues to pass through the electromagnetic pump pipe 70 and is pumped up to the upper end portion U (an upper end of the electromagnetic pump pipe 70 (the extended portion 70E)) (R1 in FIG. 3).

At this time, the molten metal M passes only through the electromagnetic pump pipe 70 and is pumped up to the upper end portion U. In other words, the molten metal M is pumped up to the upper end portion U in a path without steps. Therefore, the molten metal M does not remain inside the electromagnetic pump pipe 70.

Further, the molten metal M, which flows to the extended portion 70E of the electromagnetic pump pipe 70, falls by gravity and flows down into the molten metal supply pipe 80 (a part of the molten metal supply pipe 80, which is closer to the molten metal supply opening 22 than the insertion portion 80P) (R2 in FIG. 3). At this time, the molten metal M flows down by gravity inside the molten metal supply pipe 80 from the electromagnetic pump pipe 70. Therefore, the molten metal M does not remain inside when flowing into the molten metal supply pipe 80 from the electromagnetic pump pipe 70.

Moreover, the molten metal M, which falls by gravity and flows into the molten metal supply pipe 80, continues to be supplied into the molten metal supply opening 22 of the injection sleeve 20 through the molten metal supply pipe 80 (R3 in FIG. 3). At this time, the molten metal M passes only through the molten metal supply pipe 80 and then is supplied to the molten metal supply opening 22. In other words, the molten metal M is supplied to the molten metal supply opening 22 in a path without steps. Therefore, the molten metal M does not remain inside the molten metal supply pipe 80.

In short, while the molten metal M is pumped up to the upper end portion U by the electromagnetic pump pipe 70 from the molten metal holding furnace 40 and supplied to the molten metal supply opening 22 of the injection sleeve 20 by the molten metal supply pipe 80, the molten metal M flows in the pipes without steps only by gravity. Thus, the molten metal M does not remain inside the electromagnetic pump pipe 70 and the molten metal supply pipe 80.

Effects of the die casting apparatus 100 are explained. According to the die casting apparatus 100, clogging the die casting apparatus 100 with the molten metal M is prevented, thereby improving maintainability.

In short, according to the die casting apparatus 100, while the molten metal M is pumped up to the upper end portion U of the supply piping H from the molten metal holding furnace 40 through the electromagnetic pump pipe 70, and is further supplied to the molten metal supply opening 22 of the injection sleeve 20 through the molten metal supply pipe 80, the molten metal M flows in the pipes without steps only by gravity. Therefore, the molten metal M does not remain inside the electromagnetic pump pipe 70 and the molten metal supply pipe 80.

Therefore, in the electromagnetic pump pipe 70 and the molten metal supply pipe 80, clogging with the molten metal M is prevented. Thus, works for removing clogging the die casting apparatus 100 with the molten metal M are reduced, and maintainability of the die casting apparatus 100 is thus improved.

Further, according to the die casting apparatus 100, inside of piping from the electromagnetic pump pipe 70 to the molten metal supply pipe 80 is structured so as to be sealable. By creating a sealed space between the electromagnetic pump pipe 70 and the molten metal supply pipe 80, the molten metal M is not exposed to the atmosphere, similarly to the die casting apparatus according to the related art. Thus, oxidation of the molten metal M is suppressed, thereby preventing clogging the die casting apparatus 100 with the molten metal M and improving maintainability.

Furthermore, according to the die casting apparatus 100, the opening and closing portion 81 is provided on the upper end side of the molten metal supply pipe 80. Therefore, even when the upper end portion U is clogged with the molten metal M, the opening and closing portion 81 is opened, and the clogging the upper end portion U with the molten metal M inside the molten metal supply pipe 80 is removed easily. Thus, maintainability is improved.

Further, according to the die casting apparatus 100, the heater 90 is provided on the upper end side of the electromagnetic pump pipe 70 and the molten metal supply pipe 80. Thus, it is possible to prevent the molten metal M from solidifying. Therefore, clogging the die casting apparatus 100 with the molten metal M is prevented, thereby improving maintainability.

Moreover, according to the die casting apparatus 100, the sealing material 74 is wound on the protective pipe 72, but not on the electromagnetic pump pipe 70 or the molten metal supply pipe 80. Thus, an effect of heat of the molten metal M on the sealing material 74 is reduced.

What is claimed is:

1. A die casting apparatus comprising:

an electromagnetic pump pipe provided with an electromagnetic pump; and a molten metal supply pipe connected with the electromagnetic pump pipe, wherein molten metal is pumped up from a molten metal holding furnace through the electromagnetic pump pipe provided with the electromagnetic pump, the pumped-up molten metal is supplied to an injection sleeve through the molten metal supply pipe connected with the electromagnetic pump pipe, and a cavity of a die is charged with the pumped-up molten metal by injecting the molten metal by using an injection tip, an upper end side of the electromagnetic pump pipe and an upper end side of the molten metal supply pipe are connected with each other, and the upper end side of the electromagnetic pump pipe is inserted into the upper end side of the molten metal supply pipe, and extends inside the molten metal supply pipe.

2. The die casting apparatus according to claim 1, wherein inside of piping from the electromagnetic pump pipe to the molten metal supply pipe is structured so as to be sealable.

3. The die casting apparatus according to claim 1, wherein an opening and closing portion is provided on the upper end side of the molten metal supply pipe.

4. The die casting apparatus according to claim 1, wherein a heater is provided on the upper end sides of the electromagnetic pump pipe and the molten metal supply pipe.

5. The die casting apparatus according to claim 1, wherein an extended portion of the electromagnetic pump pipe extends to a part of the molten metal supply pipe, which is closer to a molten metal supply opening than an insertion portion of the molten metal supply pipe.

6. The die casting apparatus according to claim 1, wherein the molten metal supply pipe extends downward continuously when the molten metal supply pipe extending towards the molten metal supply opening side, from a part of the molten metal supply pipe, in which an extended portion of the electromagnetic pump pipe extends, to a part of the molten metal supply pipe, which is inserted into the molten metal supply opening.

7. The die casting apparatus according to claim 1, wherein the electromagnetic pump pipe extends upwardly to be inclined to a horizontal plane, and the molten metal supply pipe extends upwardly to be inclined to the horizontal plane.

8. The die casting apparatus according to claim 1, wherein the upper end side of the electromagnetic pump pipe and the upper end side of the molten metal supply pipe are connected with each other orthogonally.

* * * * *